US007143449B2

(12) United States Patent
Young

(10) Patent No.: US 7,143,449 B2
(45) Date of Patent: Dec. 5, 2006

(54) GARMENT WITH RESTRICTED INTERNAL ACCESS

(76) Inventor: Barbara Faye Young, 19 Glenwood Crescent, Stony Plain, Alberta (CA) T7Z 1A2

( * ) Notice: Subject to any disclaimer, the term of this patent is extended or adjusted under 35 U.S.C. 154(b) by 123 days.

(21) Appl. No.: 10/839,371

(22) Filed: May 5, 2004

(65) Prior Publication Data

US 2004/0231026 A1 Nov. 25, 2004

(30) Foreign Application Priority Data

May 21, 2003 (CA) ..... 2429525

(51) Int. Cl.
*A41D 13/12* (2006.01)
*A41D 10/00* (2006.01)
*A61B 19/12* (2006.01)

(52) U.S. Cl. ..... 2/69; 2/79; 2/80; 2/83; 128/869

(58) Field of Classification Search ..... 2/108, 2/113–115, 69, 69.5, 79, 80, 83, 8; 128/869, 128/873, 8
See application file for complete search history.

(56) References Cited

U.S. PATENT DOCUMENTS 2,462,165 A * 2/1949 Condon ..... 2/69.5
3,496,572 A * 2/1970 Herzig ..... 2/457
4,308,622 A * 1/1982 Maddron ..... 2/79
5,048,122 A 9/1991 Prieur
5,418,978 A 5/1995 Hochman
5,526,533 A * 6/1996 Plemmons, Sr. ..... 2/79
5,806,096 A 9/1998 Pennington
5,911,312 A 6/1999 Holyfield
5,933,864 A * 8/1999 Boykins ..... 2/69

FOREIGN PATENT DOCUMENTS

CA 2195233 7/1998

* cited by examiner

*Primary Examiner*—Gloria M. Hale
(74) *Attorney, Agent, or Firm*—Davis & Bujold, P.L.L.C.

(57) ABSTRACT

A garment with restricted internal access has an upper portion adapted to cover an upper body of a wearer and a lower portion adapted to cover a lower body of the wearer. The upper portion and the lower portion of the body are secured together to prevent access between the upper body portion and the lower body portion. The upper portion has a peripheral sidewall with elongate arm accommodating sleeves. A liner lines the upper portion. An internal pocket is formed by circumferentially securing the liner to the peripheral sidewall of the upper portion a spaced interval below the sleeves. The sleeves of the liner are independent of the sleeves of the upper portion. When the wearer withdraws his or her arm from one of the sleeves of the upper portion, the sleeves of the liner continue to engage the arm and the wearer's internal access to the body is restricted to the internal pocket.

3 Claims, 4 Drawing Sheets

GARMENT WITH RESTRICTED INTERNAL ACCESS

FIELD OF THE INVENTION

The present invention relates to a garment with restricted internal access, which can be placed on a person with special needs by a care giver to prevent the special needs person from accessing an incontinent pad or gastro feeding mechanism.

BACKGROUND OF THE INVENTION

There are various degrees of physical or mental factors to be considered when providing care of persons with "special needs". A top priority is always health of the person. Persons with a mental incapacity or hyperactive disorder, often attempt to access their incontinent pads.

This imposes hygiene and health problems when fecal matter is smeared or ingested. Furthermore, persons who are equipped with gastro-feeding mechanisms are able to remove the "mic-key" from their abdomen. The internal tissues usually tear and bleed leaving the person very vulnerable to infection. Persons who develop a habit of removing their "mic-key" tend to do so frequently. The replacement cost of the "mic-key" is quite substantial.

SUMMARY OF THE INVENTION

What is required is a garment with restricted internal access, that can be worn by a person with special needs to aide the caregiver in the prevention of persons accessing their incontinent pad, gastro feeding mechanisms or both.

According to the present invention there is provided a garment with restricted internal access. The garment includes a body having a front, a rear, an upper portion adapted to cover an upper body of a wearer and a lower portion adapted to cover a lower body of the wearer. Means are provided for securing the upper portion and the lower portion of the body together to prevent access between the upper body portion and the lower body portion. The upper portion has a peripheral sidewall with elongate arm accommodating sleeves and connective shoulder portion with head accommodating access opening. A liner lines the upper portion. The liner has a peripheral sidewall with elongate arm accommodating sleeves and connective shoulder portion with head accommodating access opening. An internal pocket is formed by circumferentially securing the peripheral sidewall of the liner to the peripheral sidewall of the upper portion a spaced interval below the sleeves. The sleeves of the liner are independent of the sleeves of the upper portion, such that when the wearer withdraws his or her arm from one of the sleeves of the upper portion, the sleeves of the liner continue to engage the arm and the wearer's internal access to the body is restricted to the internal pocket.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
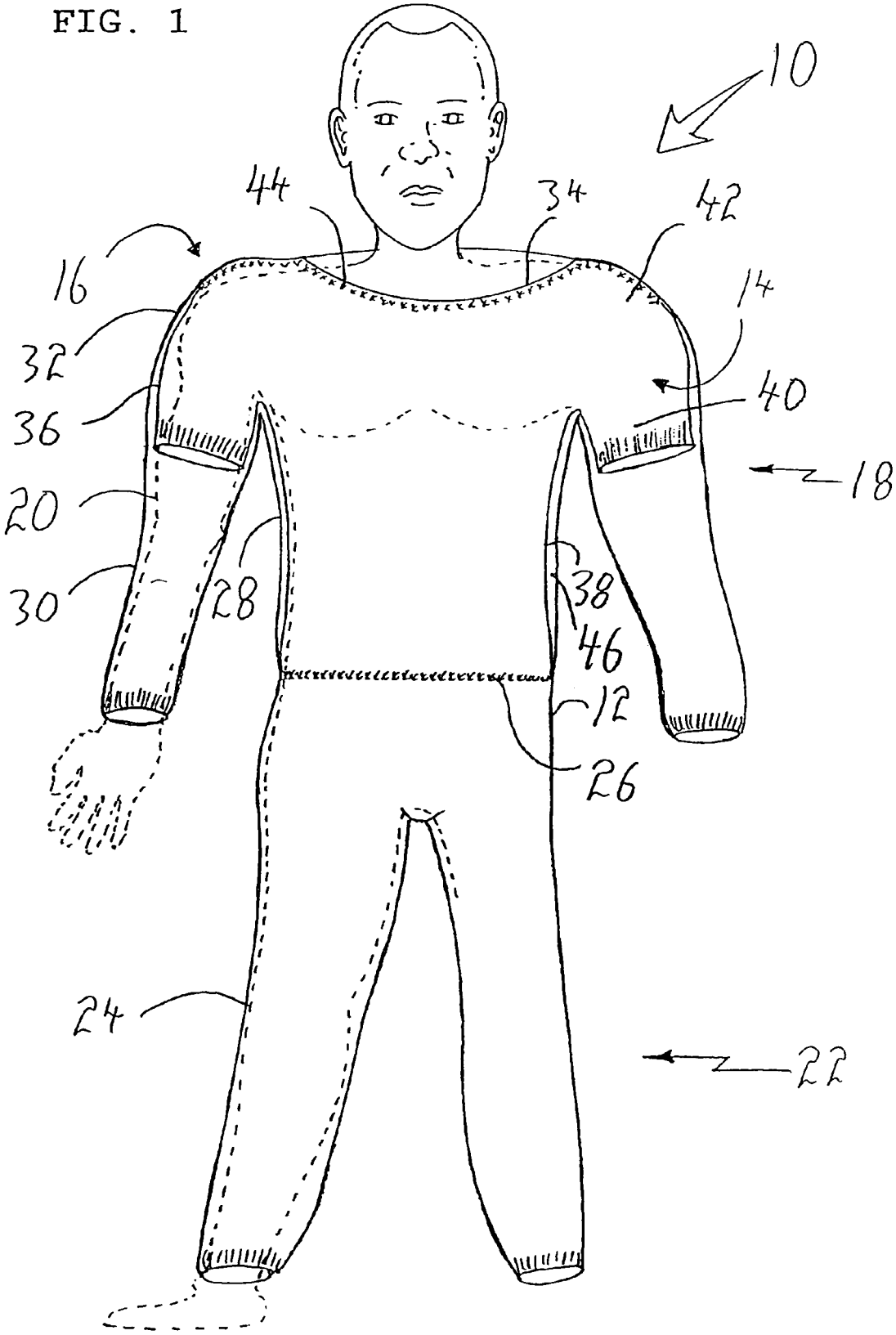
FIG. 1 is a front view in partial section of a garment with restricted internal access constructed in accordance with the teachings of the present invention.

The preferred embodiment, a garment with restricted internal access generally identified by reference numeral 10, will now be described with reference to FIGS. 1 through 4.

Figure 2:
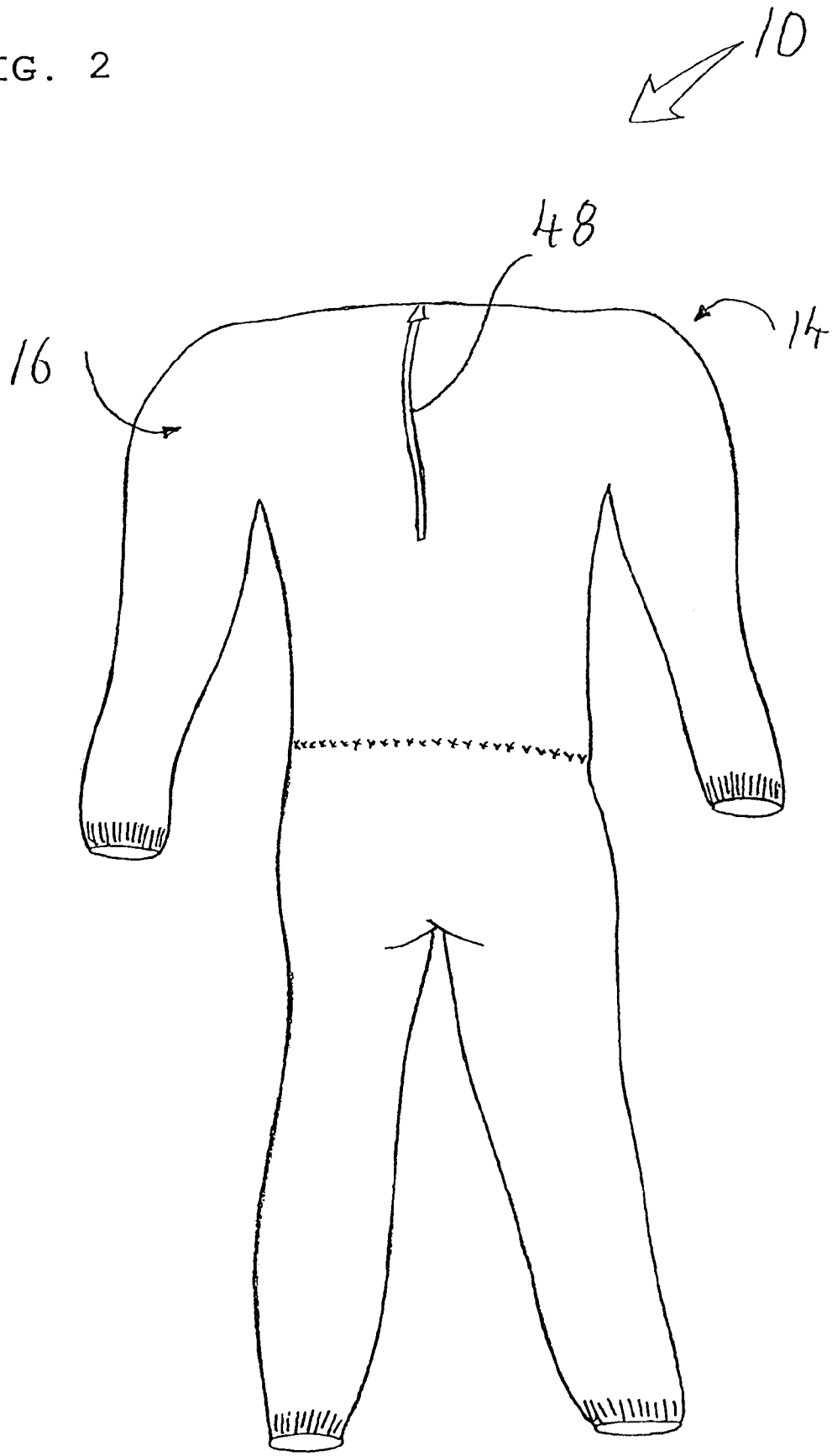
FIG. 2 is a rear view of the garment illustrated in FIG. 1
Figure 3:
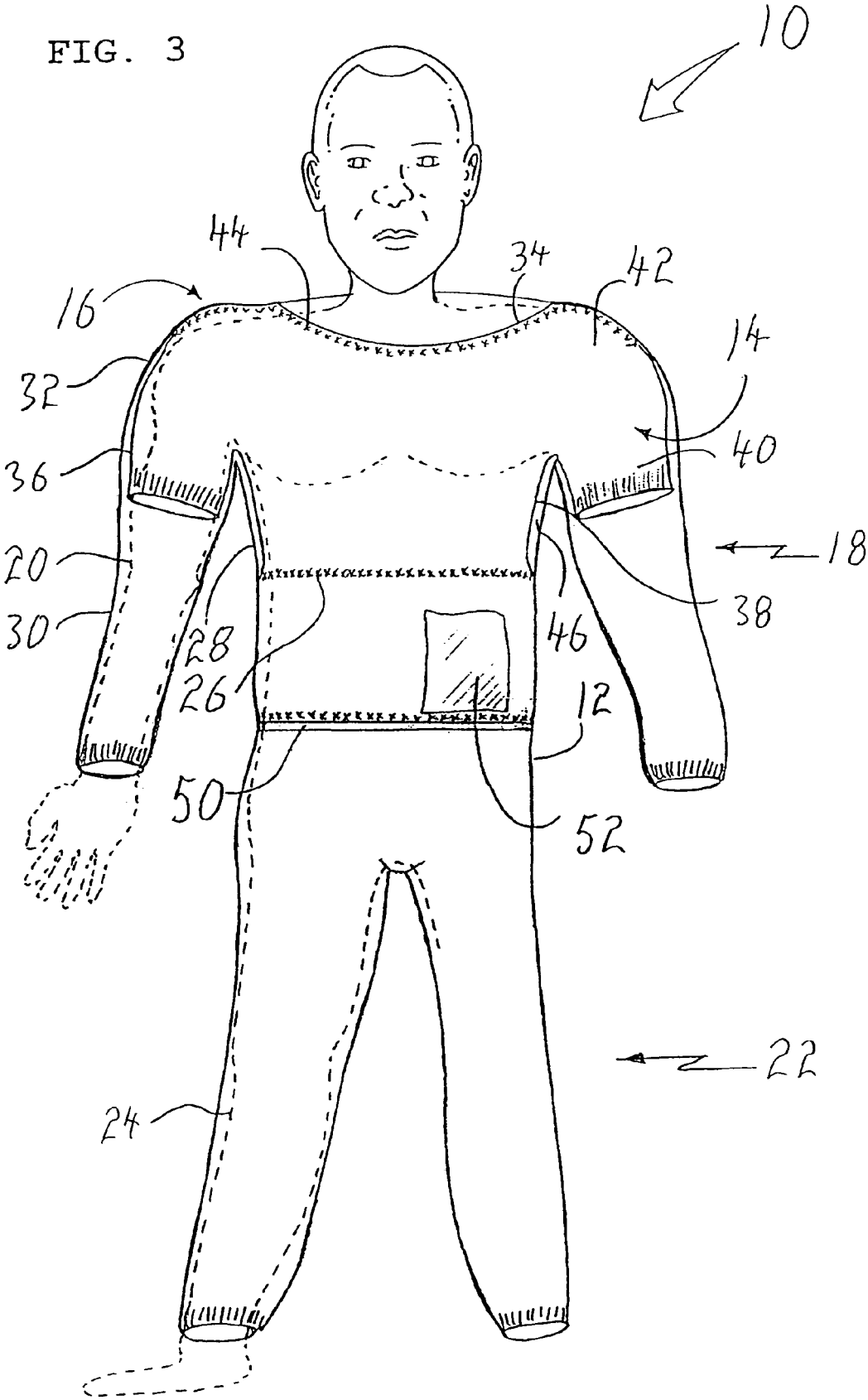
FIG. 3 is a front view partially in section of a garment with restricted internal access allowing access for gastrointestinal feeding.
Figure 4:
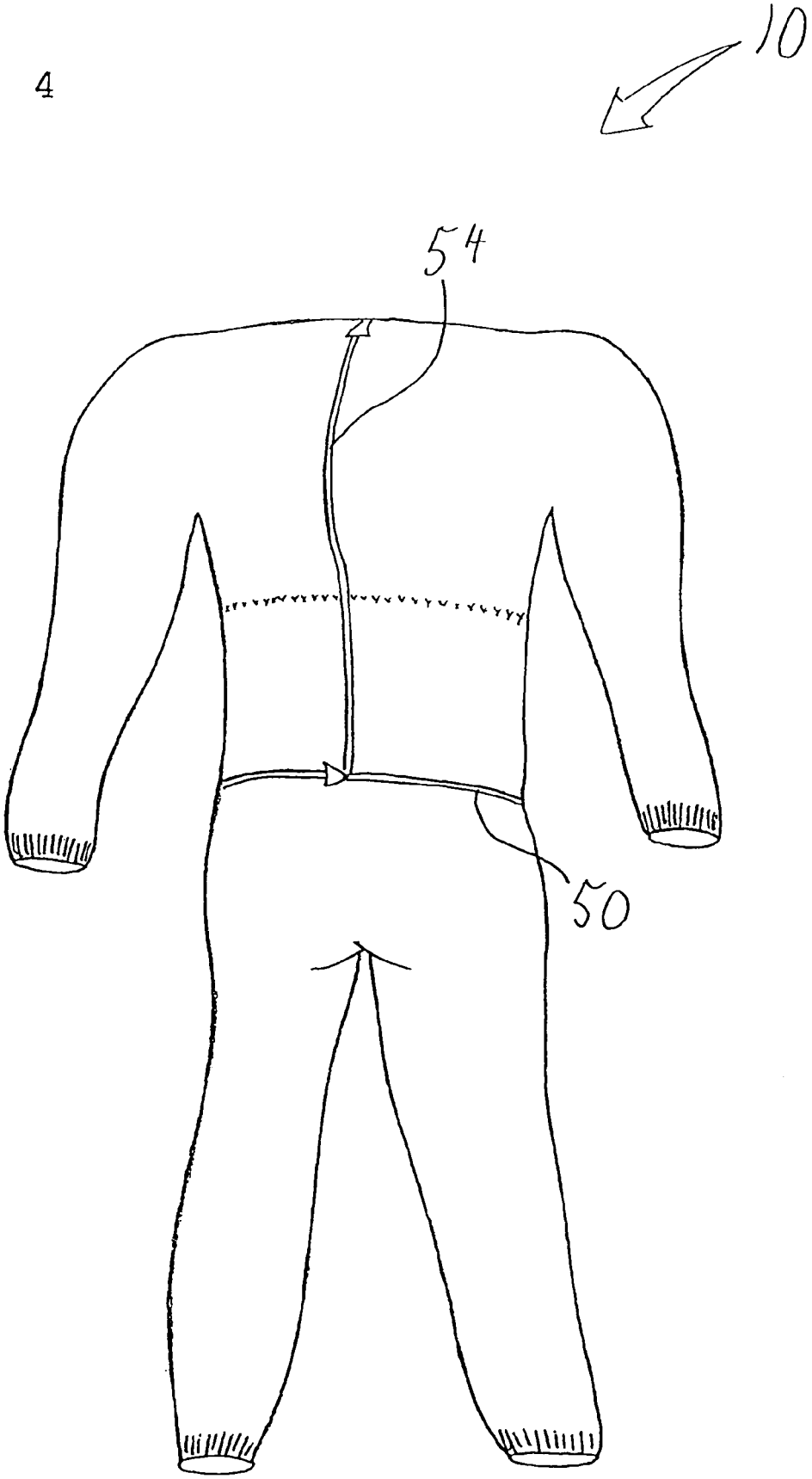
FIG. 4, is a rear view of the garment illustrated in FIG. 3

Structure and Relationship of Parts:

Referring to FIG. 1, garment with restricted internal access 10 has a body 12 with a front 14, a rear 16, an upper portion 18 adapted to cover an upper body 20 of a wearer and a lower portion 22 adapted to cover a lower body 24 of a wearer. In the illustrated embodiment, a seam 26 secures upper portion 18 to lower portion 22 such that access between upper body 20 and lower body 24 is restricted. Upper portion 18 has a peripheral sidewall 28 with elongate arm accommodation sleeves 30, connective shoulder portions 32 and a head accommodating access opening 34. A liner 36 lines upper portion 18. Liner 36 has a peripheral sidewall 38 with elongate arm accommodating sleeves 40, connective shoulder portions 42 and a head accommodating access opening 44. At a spaced interval below sleeves 30 and sleeves 40, liner 36 is circumferentially secured to peripheral sidewall 28 such that an internal pocket 46 is formed between peripheral sidewall 28 and liner peripheral sidewall 38. Referring to FIG. 2, access to garment 10 is provided for by a neck zipper 48 at rear 16. Referring to FIG. 3, garment 10 may further be adapted to allow access to a gastro feeding appliance at the wearer's abdomen (not shown). A waist zipper 50 encircles the wearers waist. Peripheral sidewall 28 is further adapted with a protective padding 52. Referring to FIG. 4, a back zipper 54 intersects waist zipper 50.

Operation:

The use and operation of a garment with restricted internal access 10 will now be described with reference to FIGS. 1 through 4. Referring to FIG. 2, neck zipper 48 is unfastened allowing a wearer to enter garment 10 and then is re-fastened. Referring to FIG. 1, a wearer is fitted into garment 10 such that upper body 20 is fitted within liner 36 which, in turn, is fitted within upper portion 18. Further, the arms of upper body 20 are fitted within sleeve 40 of liner 36 and then within sleeve 30 of upper portion 18. Although a wearer may pull the arms of upper body 20 into sleeve 30, they will remain within internal pocket 46 and will be restricted from passing to lower portion 22 at seam 26, effectively blocking access to lower body 24. Referring to FIG. 4, back zipper 54 is unfastened allowing a wearer to enter garment 10 and then is re-fastened. Further, waist zipper 50 similarly may be opened and re-fastened. Referring to FIG. 3, a wearer is fitted into garment 10 such that upper body 20 is fitted within liner 36 which, in turn, is fitted within upper portion 18. Further, the arms of upper body 20 are fitted within sleeve 40 of liner 36 and then within sleeve 30 of upper portion 18. Where needed, waist zipper 50 may be unfastened to allow access to the wearer's abdomen so that a gastro feeding appliance may be used. Once positioned, the appliance is protected by protective padding 52. Although a wearer may pull the arms of upper body 20 into sleeve 30, they will remain within internal pocket 46 and will be restricted from passing to lower portion 22 at seam 26, effectively blocking access to lower body 24 as well as any gastro feeding appliance.

As shown in FIGS. 1 and 3,the upper portion of the front of the body is devoid of any access opening in a region between the head accommodating access opening and the means for securing the upper portion to the lower portion. It is preferred that sleeve 30 be elasticized about the wrist in order to make it more difficult for the wearer to reach up the sleeve.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The invention claimed is:

1. A garment with restricted internal access, comprising:

a body having a front, a rear, an upper portion in the form of a shirt adapted to cover an upper body of a wearer and a lower portion in the form of pants adapted to cover a lower body of the wearer;

means for securing the upper portion and the lower portion of the body together to prevent access between the upper body portion and the lower body portion;

the upper portion having a peripheral sidewall with elongate arm accommodating sleeves and connective shoulder portion with a head accommodating access opening: and the upper portion of the front of the body being devoid of any access opening in a region between the head accommodating access opening and the means for securing the upper portion to the lower portion;

a liner lining the upper portion, the liner having a peripheral sidewall with elongate arm accommodating sleeves and connective shoulder portion with head accommodating access opening;

an internal pocket with a closed bottom being formed by circumferentially securing the peripheral sidewall of the liner to the peripheral sidewall of the upper portion at a spaced interval below the sleeves; and the sleeves of the liner being independent of the sleeves of the upper portion, such that when the wearer withdraws his or her arm from one of the sleeves of the upper portion, the sleeves of the liner continue to engage the arm and the wearer's internal access to the body is restricted to the internal pocket.

2. A garment with restricted internal access, comprising:

a body having a front, a rear, an upper portion in the form of a shirt adapted to cover an upper body of a wearer and a lower portion in the form of pants adapted to cover a lower body of the wearer;

means for securing the upper portion and the lower portion of the body together to prevent access between the upper body portion and the lower body portion;

the upper portion having a peripheral sidewall with elongate arm accommodating sleeves and connective shoulder portion with a head accommodating access opening; and the upper portion of the front of the body being devoid of any access opening in a region between the head accommodating access opening and the means for securing the upper portion to the lower portion;

a liner lining the upper portion, the liner having a peripheral sidewall with elongate arm accommodating sleeves and connective shoulder portion with head accommodating access opening;

an internal pocket with a closed bottom being formed by circumferentially securing the peripheral sidewall of the liner to the peripheral sidewall of the upper portion at a spaced interval below the sleeves; and the sleeves of the liner being independent of the sleeves of the upper portion, such that when the wearer withdraws his or her arm from one of the sleeves of the upper portion, the sleeves of the liner continue to engage the arm and the wearer's internal access to the body is restricted to the internal pocket;

wherein the upper portion of the body has an access opening at the rear.

3. A garment having restricted internal access, the garment comprising:

a body having a front, a rear, an upper portion comprising a shirt adapted to cover an upper body of a wearer and a lower portion comprising pants adapted to cover a lower body of the wearer;

a securing mechanism for securing the upper portion and the lower portion of the body together to prevent access between the upper body portion and the lower body portion;

the upper portion having a peripheral sidewall with elongate arm accommodating sleeves and a connective shoulder portion with a head accommodating access opening; and the upper portion of the front of the body being devoid of any access opening in a region between the head accommodating access opening and the means for securing the upper portion to the lower portion;

a liner lining the upper portion, the liner having a peripheral sidewall with elongate arm accommodating sleeves and a connective shoulder portion with a head accommodating access opening;

an internal pocket with a closed bottom being formed by circumferentially securing the peripheral bottom edge of the liner to the peripheral sidewall of the upper portion at a spaced interval below the sleeves; and the sleeves of tile liner being independent of the sleeves of the upper portion such that when the wearer withdraws his or her arm from one of the sleeves of the upper body portion, the sleeves of the liner continue to engage the arm and the internal access of the wearer tb his or her body is restricted to the internal pocket.

* * * * *